US006161314A

United States Patent [19]

Kamrin

[11] Patent Number: 6,161,314

[45] **Date of Patent: *Dec. 19, 2000**

[54] LEASH FOR INFANT FOOTWEAR

[76] Inventor: Lori S. Kamrin, 4459 249th Ter. Southeast, Issaquah, Wash. 98029

[ * ] Notice: This patent issued on a continued prosecution application filed under 37 CFR 1.53(d), and is subject to the twenty year patent term provisions of 35 U.S.C. 154(a)(2).

[21] Appl. No.: 09/175,076

[22] Filed: Oct. 19, 1998

[51] Int. Cl.[7] ..... A43B 3/30; A44B 21/00

[52] U.S. Cl. ..... 36/112; 36/132; 24/3.2; 24/115 H

[58] Field of Search ..... 36/132, 136, 112; 224/220, 221, 247; 24/115 G, 115 H, 3.2; 280/809, 637

[56] References Cited

U.S. PATENT DOCUMENTS 4,976,050 12/1990 Houghteling .

*Primary Examiner*—Paul T. Sewell
*Assistant Examiner*—J. Mohandesi
*Attorney, Agent, or Firm*—Christensen O'Connor Johnson & Kindness PLLC

[57] ABSTRACT

An infant footwear leash for preventing the loss of footwear worn by infants is provided. The leash includes a string and a slidable element through which the ends of the strings are completely inserted to define a loop that rests around the infant's ankle, while the leash is in use. In an open position, the slidable element allows adjustment of the size of the loop as necessary. In a closed position, the slidable element prevents adjustment of the size of the loop to prevent the loop from enlarging and causing the leash to fall off the infant's foot. A clip is attached to one end of the string. The clip is clipped onto the infant footwear. Thus, if the footwear falls off the infant's foot, it is held by the clip and is kept dangling from the leash.

1 Claim, 1 Drawing Sheet

LEASH FOR INFANT FOOTWEAR

FIELD OF THE INVENTION

The present invention relates generally to infant footwear, and more particularly to a device secured to infant footwear to prevent loss of the footwear.

BACKGROUND OF THE INVENTION

The opening defined by the ankle portion in infant footwear is generally almost as large as the infant's foot because an infant's foot is generally only slightly larger than the infant's ankle. Therefore, infant footwear may easily slip off the infant's foot. In addition, infant footwear is typically made of soft material and is lightweight. Therefore, when the footwear falls off the infant's foot and makes contact with the ground, the footwear does not make an audible noise to alert an adult with the infant that the footwear has fallen off the infant's foot. When the adult eventually discovers that the footwear is no longer on the infant's foot, it may be too late to recover or to find the lost footwear.

One solution to prevent loss of the infant footwear is to design the footwear with a band sewn to the portion of the footwear wrapping the infant's ankle such that the elastic band extends about the ankle, as shown in U.S. Pat. No. 4,976,050 issued to Houghteling. A male and female member of a snap fit fastener are attached respectively to opposite ends of the elastic band to secure the footwear about the infant's ankle. Although this solution may be successful in keeping the footwear on the infant's feet, the solution causes other problems. The elastic band may cause discomfort to the infant. Furthermore, the elastic band must be incorporated into the footwear and thus, cannot be adapted to be used with already existing footwear.

A brace for infant footwear disclosed in U.S. Pat. No. 5,445,598 does not have to be incorporated into the footwear when manufactured. However, the brace may cause discomfort to the infant. The brace is comprised of a band that is slipped over the infant's foot to rest around the ankle portion of the footwear being worn. Then, the band is twisted once to form another loop which is stretched over the foot and released around the arch portion of the footwear.

Therefore, a need arises for a device that prevents loss of the infant footwear, without exerting additional pressure on the infant's foot and causing discomfort to the infant. The device should be capable of use with various footwear, including existing footwear.

SUMMARY OF THE INVENTION

The present invention provides an infant footwear leash for use with and to prevent the loss of infant footwear. The leash includes a string and a slidable element. The slidable element defines a hole therethrough through which the ends of the string are completely inserted. The string thus defines a loop that rests around the infant's ankle when the leash is in use. A clip is attached to one end of the string. The clip is clipped onto the infant footwear. Thus, if the infant footwear falls off the infant's foot, it is held by the clip and is kept dangling from the leash.

In an open position, the slidable element allows adjustment of the string. Adjustment of the string allows the loop to be enlarged before slipping the loop over the infant's foot in preparation for use or slipping the loop from the infant's foot after use. Also, the string can be tightened around the infant's ankle after the loop is slipped over the infant's foot. In a closed position, the slidable element prevents the adjustment of the string to prevent the loop from enlarging and the leash from falling off the infant's foot.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
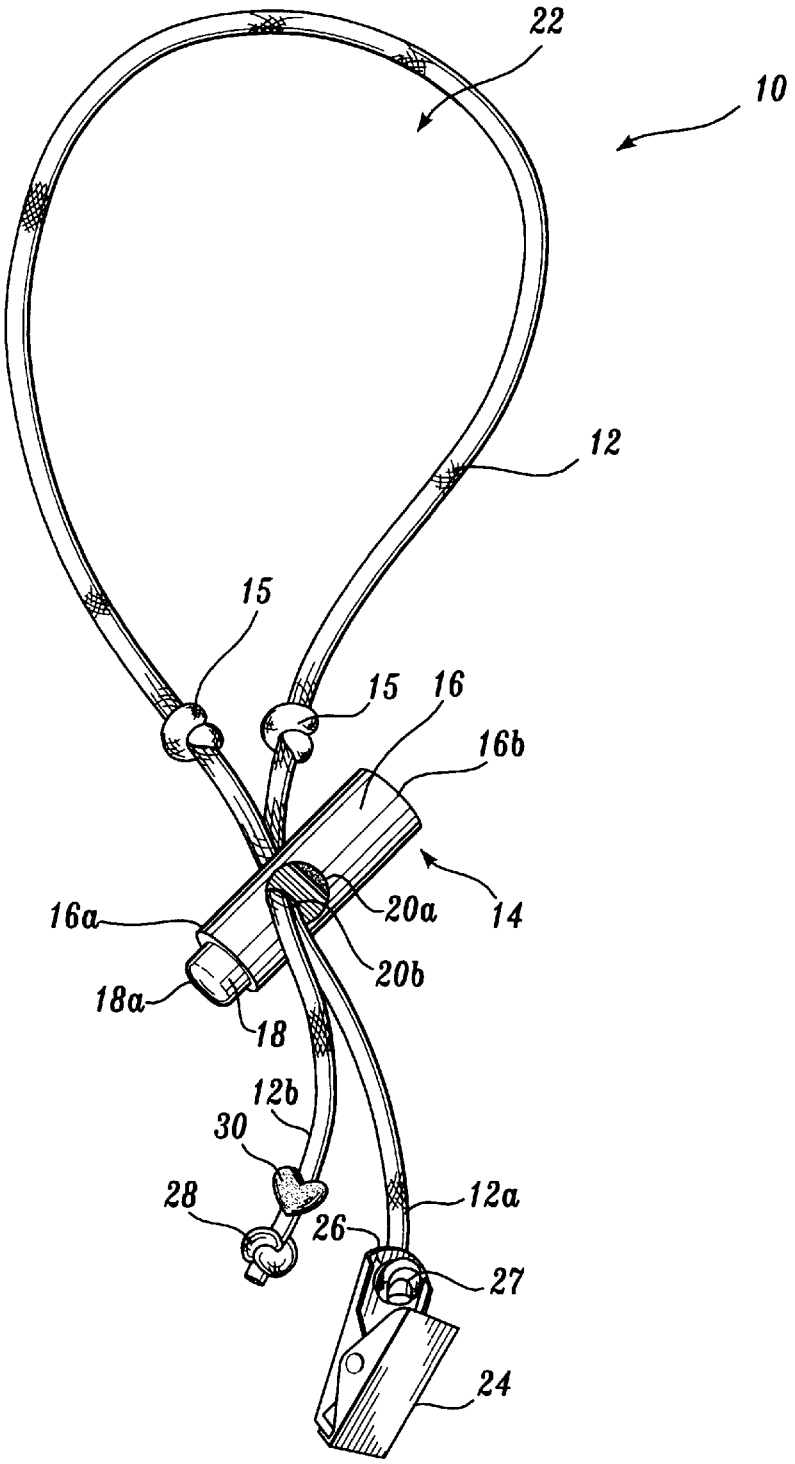
FIG. 1 is a perspective view of an infant footwear leash with a slidable element in a closed position, according to a preferred embodiment of the invention.

The present invention provides an infant footwear leash 10 to prevent the loss of footwear worn by infants. The leash 10 may be used on various types of infant footwear, including socks, soft shoes, booties and moccasins.

FIG. 1 is a perspective view of the infant footwear leash 10 according to a preferred embodiment of the invention. The leash 10 includes a flexible string 12. The string 12 is made preferably of a fabric such as cotton to provide maximum comfort. The fabric can be interwoven to increase the durability of the string 12. In the preferred embodiment, the string 12 is approximately 6 inches long. The string can have a circular cross section with a diameter preferably about a ⅛ of an inch. Alternatively, the string can be an essentially flat piece of cotton fabric with a width of approximately ½ of an inch. Furthermore, the string 12 can be made of stretchable material. The dimension and shape of the cross section of the string 12 is not critical to the operation of the invention.

The leash 10 also includes a slidable element 14. The slidable element is preferably made of a suitable polymeric material, such as plastic. The slidable element should be lightweight and void of sharp corners to prevent any discomfort to the infant. The slidable element 14 includes an outer component 16, preferably cylindrical in shape and preferably about ½ an inch in diameter, and an inner component 18, also preferably cylindrical in shape and smaller than the outer component 16 in diameter. The outer component defines a cavity by its inside diameter, and has an open end 16*a* and a closed end 16*b*. The inner component 18 rests inside the cavity of the outer component 16 with a pushbutton end 18*a* of the inner component 18 jutting from the open end 16*a* of the outer component 16. The inner component 18 is shorter than the outer element 16 and therefore, does not fill the entire cavity leaving a smaller cavity defined by the closed end 16*b* of the outer component 16 and the end of the inner component 18 opposite of the pushbutton end 18*a*. A spring (hidden) positioned in the smaller cavity biases the slidable element 14 in a closed position as shown in FIG. 1.

The outer component 16 and the inner component 18 both define holes 20*a* and 20*b* running therethrough. When the pushbutton end 18*a* is released, the spring remains extended and the holes defined by the outer component and the inner component do not coincide, maintaining the slidable element 14 in the closed position. That is, the inner component 18 blocks the hole 20*a* defined by the outer component 16. When the pushbutton end 18*a* is depressed, the spring is compressed and the holes 20*a* and 20*b* coincide, placing the slidable element in an open position.

When the slidable element 14 is in the open position, ends 12*a* and 12*b* of the string 12 can be completely inserted through the coinciding holes 20*a* and 20*b*. Both ends 12*a* and 12*b* can be inserted into the same side of the holes as shown in FIG. 1 or can be inserted into opposing sides of the holes. With its ends 12*a* and 12*b* completely inserted through the holes 20*a* and 20*b*, the string 12 defines a loop 22.

Any of various types of conventional clips 24 is attached to one end 12*a* of the string 12. The clip can include a hole 26 through which the end 12*a* of the string 12 can be inserted. A conventional knot 27 can be made at the end 12*a* of the string to keep the string from sliding out of the hole 26 on the clip 24. Alternatively, the clip can be attached to the string 12 by an adhesive or other suitable means. The clip 20 can be made of plastic or metal or other lightweight material.

The other end 12*b* of the string can be tied into a conventional knot 28. The knot 28 must be bigger than the holes 20*a* and 20*b* of the outer component 16 and the inner component 18 to prevent the end 12*b* of the string from sliding through the holes 20*a* and 20*b* and making the string 12 lose its loop configuration. Optionally, a trinket or trinkets 30 can be attached to either or both ends 12*a* and 12*b* of the string 12.

In use, before slipping the loop 22 over an infant's foot, the pushbutton end 18*a* is depressed, placing the sidable element 14 in the open position. The holes 20*a* and 20*b* coincide allowing the string to be pulled through the holes in a direction that increases the size of the loop 22 while the pushbutton end remains depressed. The size of the loop is increased to a size sufficient to fit through the particular infant's foot. The loop is then slipped over the infant's foot and rests around the infant's ankle. The loop is then tightened to prevent the loop from slipping over and falling off the infant's foot. To tighten the loop, the pushbutton end 18*a* is again depressed and the string is pulled in an opposite direction that decreases the size of the loop to fit comfortably around the infant's ankle. The pushbutton end 18 is then released, placing the slidable element in the closed position. In the closed position, the slidable element 14 prevents relative sliding movement between the string 12 and the slidable element 14. Adjustment of the size of the loop is thus prevented, to prevent the loop 22 from enlarging and the leash 10 from falling off the infant's foot.

Two conventional knots 15 can be optionally tied on the portion of the string 12 forming the loop 22 to prevent the loop 22 from being accidentally decreased to a size that would cause discomfort to the infant. The knots 15 are larger in diameter than the holes 20*a* and 20*b* on the slidable element 14 to prevent the knots 15 from sliding through the holes 20*a* and 20*b*.

In use, the clip 24 is clipped onto the infant's shoe or booty. For example, the clip 24 can be clipped onto a back top edge of the shoe or booty. If the shoe falls off the infant's foot, the shoe is held by the clip 24 and dangles from the leash 10 rather than dropping to the ground and potentially be lost.

While the preferred embodiment of the invention has been illustrated and described, it will be appreciated that various changes can be made therein without departing from the spirit and scope of the invention. For example, the slidable element 14 can be omitted and the string can be merely tied around the infant's ankle in the same manner that a shoe lace is typically tied. In addition, the slidable element can be replaced by any other conventional clamp. Furthermore, the leash 10 can also be used with handwear, such as gloves or mittens.

The embodiments of the invention in which an exclusive property or privilege is claimed are defined as follows:

1. A method of securing an infant footwear or handwear, the method comprising the steps of:

forming a loop around the ankle or wrist of the infant with a string, the string having two free ends;

forming two knots on said loop to define a minimum size of the loop;

slipping a slidable clamp about said string by passing said two free ends of said string through a hole of said slidable clamp when in an open position, said slidable clamp allowing adjustment of the size of said loop when in the open position and preventing adjustment to the size of said loop when in a closed position, said two knots formed on said loop positioned to prevent said loop from being decreased in size by adjustment of the slidable clamp about said string to a size that causes discomfort to the infant;

attaching a clip at one of said two free ends of said string and forming a knot at the other of said two free ends of said string to prevent said slidable clamp from being slidably removed from said string; and securing said clip to the infant footwear or handwear.

* * * * *

UNITED STATES PATENT AND TRADEMARK OFFICE

CERTIFICATE OF CORRECTION

PATENT NO. : 6,161,314
DATED : December 19, 2000
INVENTOR(S) : L.S. Kamrin

It is certified that error appears in the above-identified patent and that said Letters Patent is hereby corrected as shown below:

Title page,
Item [56], References Cited, insert in appropriate numerical order the following:

| | | |
|---|---|---|
| -- 5,459,903 | 10/1995 | Treacy |
| 4,159,792 | 7/1979 | Siegal |
| 4,815,642 | 3/1989 | Ray |
| 5,058,524 | 10/1991 | Guthrie, Jr. |
| 2,840,873 | 7/1958 | Meier |
| 4,393,550 | 7/1983 | Yang et al. |
| 3,802,011 | 4/1974 | Castagnola -- |

Signed and Sealed this

Twenty-fifth Day of December, 2001

*Attest:*

*Attesting Officer*

JAMES E. ROGAN
*Director of the United States Patent and Trademark Office*